United States Patent [19]

Sebastiani et al.

[11] Patent Number: 4,695,193

[45] Date of Patent: Sep. 22, 1987

[54] SLENDER FLEXIBLE MARINA STRUCTURE FOR HYDROCARBON PRODUCTION AND SHIP MOORING IN DEEP SEAS

[75] Inventors: Gaetano Sebastiani, Mestre; Roberto Brandi; Francesco Di Lena, both of Padua; Silvestro Vanore, Mestre; Roberto Carraro, Padua, all of Italy

[73] Assignee: Tecnomare S.p.A., Venice, Italy

[21] Appl. No.: 605,164

[22] Filed: Apr. 30, 1984

[30] Foreign Application Priority Data

May 9, 1983 [IT] Italy ..... 84116 A/83

[51] Int. Cl.[4] ..... E02B 17/00

[52] U.S. Cl. ..... 405/204; 405/202

[58] Field of Search ..... 405/195, 202, 203, 204, 405/224

[56] References Cited

U.S. PATENT DOCUMENTS

| | | | |
|---|---|---|---|
| 4,170,266 | 10/1979 | Fayren | 405/195 X |
| 4,187,038 | 2/1980 | Taylor | 405/204 |
| 4,188,156 | 2/1980 | Fisher et al. | 405/195 |
| 4,256,417 | 3/1981 | Bohannon | 405/195 |
| 4,363,567 | 12/1982 | Van Der Graaf | 405/195 |
| 4,511,287 | 4/1985 | Horton | 405/204 |

*Primary Examiner*—David H. Corbin

*Attorney, Agent, or Firm*—Birch, Stewart, Kolasch & Birch

[57] ABSTRACT

A flexible structure of controlled yieldability for use as a hydrocarbon drilling and production platform in deep seas, or as a mooring point for oil tankers, constituted by a foundation base assembly, a vertical cylindrical tubular element placed under tension by a buoyancy chamber disposed at its top in proximity to the water surface, and an overlying lattice which at its top supports the plant platform.

The tubular element is connected at its lower end to the base and at its upper end to the buoyancy chamber by means of suitable profiled tapered terminal elements able to withstand the bending loads which are generated at said connections.

The entire structure is constituted by four separate pieces, namely the foundation base assembly with the lower terminal element, the lower half of the cylindrical tubular element, the upper half thereof, and the upper buoyancy chamber which is connected at one end to the upper terminal connection element and at the other end to the top lattice.

For transportation purposes, these four pieces are assembled telescopically in pairs.

On final on-site installation, the telescopic tubular parts are connected together and to the respective profiled terminal elements by mechanical clamps which restore complete structural continuity along the entire axis of the structure.

9 Claims, 8 Drawing Figures

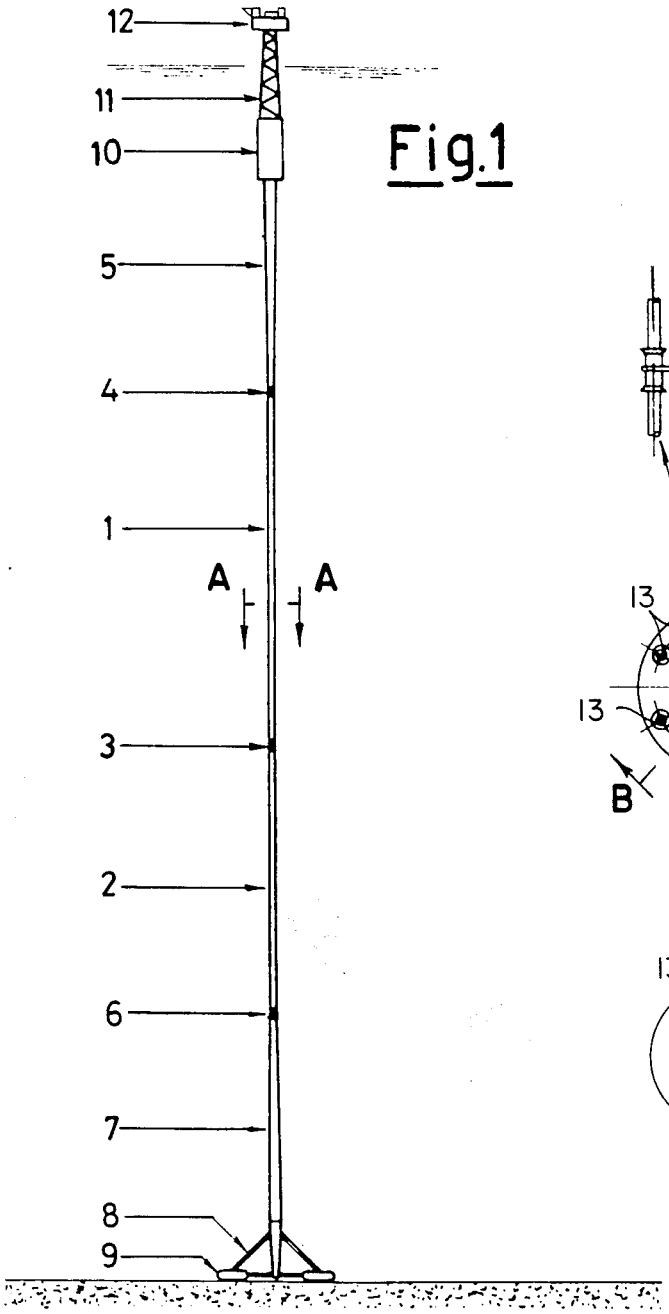
Fig.1
Fig. 1B
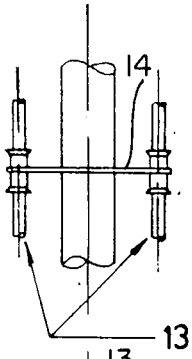
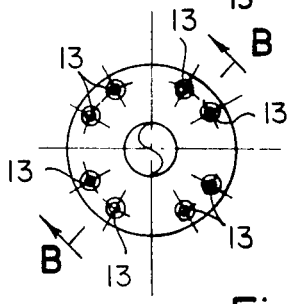
Fig. 1A
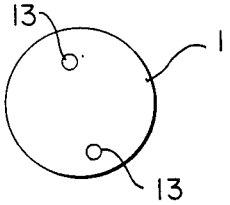
Fig. 1C

SLENDER FLEXIBLE MARINA STRUCTURE FOR HYDROCARBON PRODUCTION AND SHIP MOORING IN DEEP SEAS

BACKGROUND OF THE INVENTION

1. Field of the Invention

This invention relates to a structure which can be installed in deep seas and is able to support at its top a plant complex designed for various industrial activities in open sea, in particular it being usable advantageously as a hydrocarbon production platform and a mooring and loading point for oil tankers for sea depths exceeding 1000 m.

2. Description of the Prior Art

Structures such as the braced derrick and articulated derrick have been proposed and designed for hydrocarbon production in deep seas. The braced derrick, being a "yieldable structure" with its first intrinsic period above the wave period range (≧30 s) and its second intrinsic period below this (≦7 s), has a range of use in terms of water depth which is rather limited, and cannot exceed a bed depth of 500 m.

This structure also appears too complicated, sophisticated and thus costly to allow its use to extend to production in marginal (medium-small) oil and gas fields.

The articulated derrick has the drawback of possessing a critical mechanical member, namely its universal base joint, in a zone which is inaccessible for direct inspection and maintenance. Moreover, the structural discontinuity constituted by said universal joint means that the oil feed conduits which run along said structure must also comprise hinges to allow structural rotation. If the structure is used as a production platform, this configuration does not allow the well heads to be disposed at the surface, but instead requires the use of underwater well heads, leading to a considerable reduction in system reliability and a significant increase in both installation and operating costs.

For the deep-sea mooring of ships, certain of the authors of the present invention have patented (U.S. patent application Ser. No. 393,310 filed on June 29, 1982) a flexible monolithic structure concept with a buoyancy chamber close to its top, having certain apparent analogies with the structure proposed herein.

The structure corresponding to the aforesaid patent has its first intrinsic period above the wave period (≧30 s) and its second below the period of waves with a significant energy content (≦7 s). This dynamic behaviour limits the application of the concept to a water depth which cannot exceed 500–600 m.

Finally, its method of manufacture and installation, which require it to be constructed, transported and installed in a single monolithic piece, itself constitutes a limit to the depth which can be attained. A further concept which seems to have some analogy with the present invention is the SALM mooring buoy composed of a partially immersed buoy body connected to the sea bed by a vertical chain tensioned by the upward thrust on the buoy. This method cannot be extended to deep seas because, in such a case, in order to ensure the necessary rigidity of the mooring system against horizontal traction, a very high tension (many thousands of tons) would have to be applied to the anchoring line, and this could in no way be withstood by an element of chain type.

SUMMARY OF THE INVENTION

The structure according to the invention consists essentially of a long vertical cylindrical tubular element connected, by means of profiled or tapered terminal elements, at the bottom to a wide base and upperly to a buoyancy chamber which itself supports an emerging lattice carrying the plants at its top.

The foundation base can be stabilised either by the effect of its own weight or by piles driven into the ground.

The tubular column and its lower and upper terminal elements can be constructed of steel, reinforced concrete, composite components (steel-concrete-steel) or other materials.

The purpose of the upper buoyancy chamber is to place the vertical tubular element under high tension and thus ensure that the structure is able to sufficiently oppose horizontal forces applied to its top.

Compared with the SALM buoy systems, the present structure when using a steel tube as its vertical tensioning element enables very high tensions of the order of 10,000 tons or more to be attained, so providing the necessary overall system rigidity even in sea depths exceeding 1000 m.

The emerging upper lattice, connected rigidly to the buoyancy chamber, supports at its top the plants required for the use to which the structure is put.

The conduit or conduits which convey the crude oil from the sea bed to the surface run along the axis of the structure, either on the inside or outside of this latter, and are supported thereby. The central part of the tubular column is of constant cross-section, and when in operation is subjected practically only to axial tensile stress. The lower and upper terminal connection elements are however also subjected to considerable bending stresses, both static and dynamic, and their rigidity increases towards the joint so as to be able to support said bending stresses.

The internal structure is constructed in four separate pieces, of which the first is constituted by the foundation base and lower terminal element, the second by the lower half of the cylindrical column, the third by the upper half of the cylindrical column, and the fourth by the buoyancy chamber connected at one end to the upper terminal element and at the other end to the emerging lattice. For transportation purposes the second and third pieces are inserted telescopically into the first and fourth piece respectively. For site installation purposes, the telescopic parts are withdrawn and connected together and to the other two parts, namely the lower and upper part, by mechanical clamps which are located in zones not subjected to bending moments and which re-establish the complete structural continuity of the structure from the sea bed to the surface. In contrast to articulated derricks, the structural continuity of the present invention enables the oil feed conduits to be run along the structure in a structurally continuous manner as in the case of conventional fixed structures, and thus, if used as a production platform, the well heads can be disposed on the surface platform.

This makes the proposed structure suitable for exploiting marginal (medium-small) oil and gas fields in very deep seas, both because it represents a very low-cost design, and because it enables the same plants and operational methods already used in fixed shallow sea structures to be utilised.

It should also be noted that the proposed transportation and installation method, with the structure divided into parts held together telescopically, enables a much greater depth to be reached than in the case of similar monolithic structures. In the current art, marine structures have a dynamic behaviour characterised by very short intrinsic periods (≦4 s), less than those of waves with significant energy content, in order to prevent resonance phenomena. Other structures, such as the braced derrick, have their first intrinsic period longer than the wave periods and their second intrinsic period shorter than the period of waves with appreciable energy content.

In contrast, from this aspect the structure according to the present invention has no limitation. By virtue of its very high flexibility, its dynamic behaviour approaches that of a taut cable, or that of a drilling riser tensioned at its top, and it can therefore also withstand intrinsic periods which lie within the wave period range (typically from 7 to 20 s) without consequent resonance phenomena creating unacceptable states of stress. A typical configuration of this structure for 1000 m of sea depth has the following intrinsic periods: $T_1=90$ s, $T_2=20$ s, $T_3=12$ s, $T_4=8$ s, from which it can be seen that the periods $T_2$ and $T_3$ can generate resonance phenomena in that they lie clearly within the wave period range. Careful dynamic analysis has shown that such resonance phenomena are in reality very small, both because of the high degree of structure motion damping in water, and because the wave forces vary along the vertical ($F_2$, $F_3$ of FIG. 2) in a manner which opposes the shape of the mode of vibration ($M_2$, $M_3$ of FIG. 2) corresponding to the resonance period.

BRIEF DESCRIPTION OF THE DRAWINGS

The present invention will become more fully understood from the detailed description given hereibelow and the accompanying drawings which are given by way of illustration only, and thus are not limitative of the present invention, and wherein:

FIG. 1 is a front elevation of a deep sea marine structure built in accordance with the present invention;

FIG. 1A is a top cross-sectional view taken along line A—A in FIG. 1.

FIG. 1B is a partial side view taken along the line B—B in FIG. 1A.

FIG. 1C is a cross sectional view showing an alternate location of the oil-conduits FIG. 2 diagrammatically illustrates the wave forces and modes of vibration;

DETAILED DESCRIPTION OF THE PREFERRED EMBODIMENT

Figure 2:
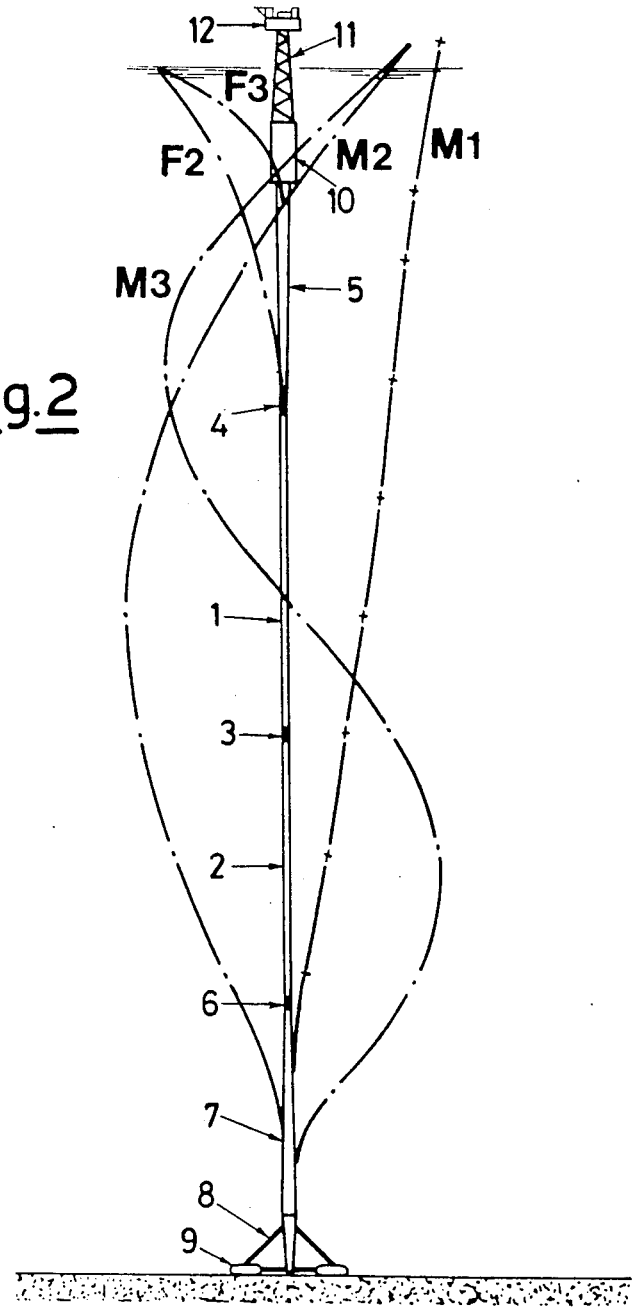

In FIG. 1, the tubular central element of constant cross-section is divided into two parts, an upper part 1 and a lower part 2. The two parts are connected together by a mechanical connection, 3. The upper part is connected by a mechanical connection 4' to the mechanical connection 4 on to the upper terminal connection element 5 and has a smaller diameter than the element 5 so that it may be positioned or telescoped therein. The lower part is connected by a mechanical connection 6 to the lower terminal connection element 7 and has a smaller diameter than the element so that it may be positioned or telescoped therein. This arrangement is useful in transporting and constructing the structure as more fully set forth below.

The said mechanical connections are used to connect the various parts of the structure together during the installation stage, and are such that when the connection is made they provide structural continuity between the elements.

Structure stability on the sea bed is provided by the foundation base assembly, which is composed of a tubular element lattice structure 8 and foundation bases 9.

If the gravity method is used, the foundation bases must contain the necessary ballast to ensure stability on the sea bed. As an alternative to this method, stability can be provided by foundation piles driven into the ground.

The upper terminal connection element is rigidly connected to the positive buoyancy chamber 10 which is positioned in proximity to the sea surface.

The emerging structure 11 connected to the buoyancy chamber is composed of a tubular element lattice structure or a single tubular element. On the upper end of the emerging structure is installed the platform 12 containing the plants necessary for the use of the structure. The conduits 13 for conveying the crude oil from the sea bed to the surface run along the axis of the structure over its entire length and may pass through the member 14 as shown in FIGS. 1A and 1B. In addition, the conduits 13 may be situated internally of the tubular elements as shown in FIG. 1C.

Figure 3:
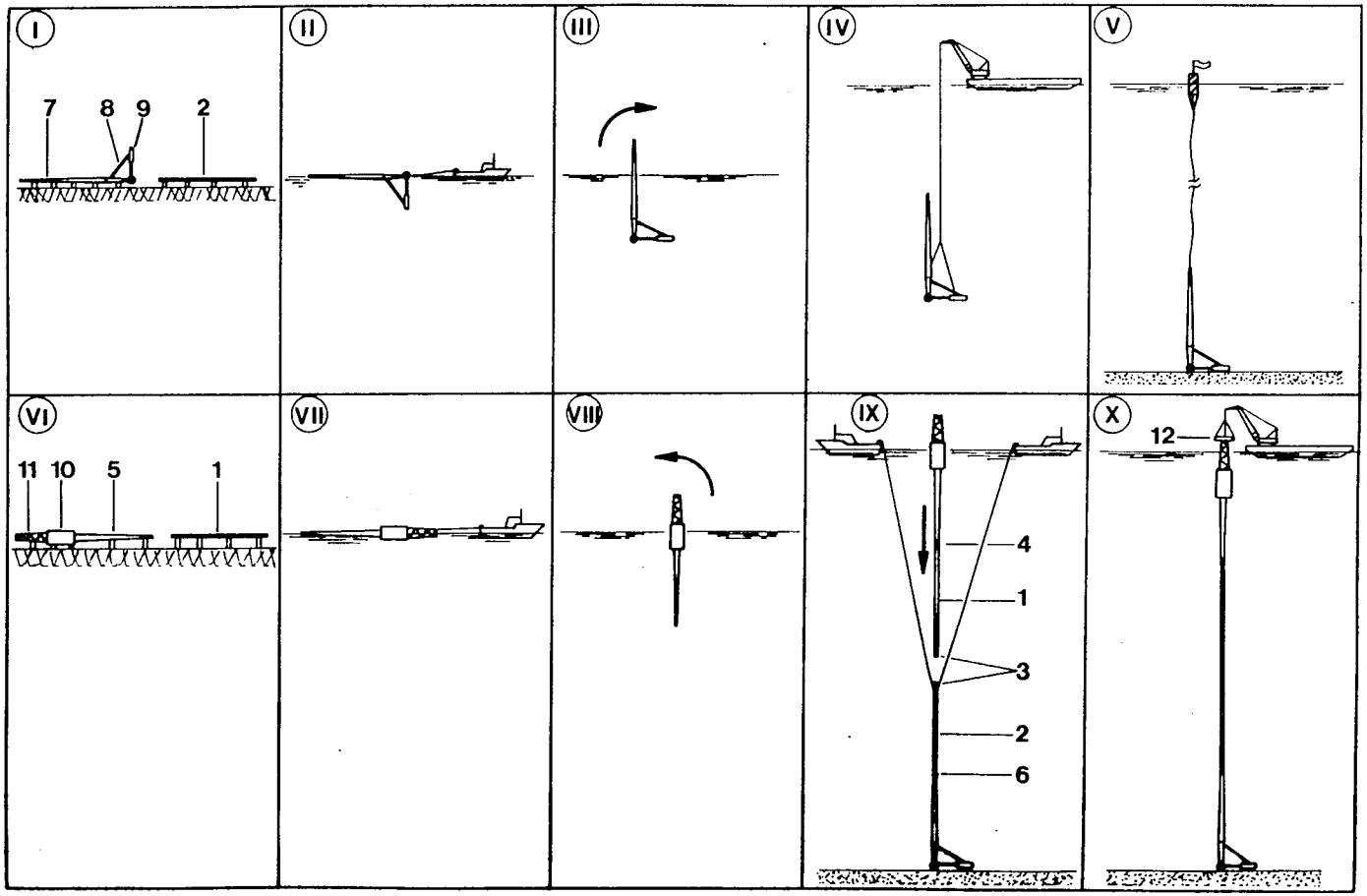
FIG. 3 diagrammatically illustrates the sequence of erecting a deep sea marine structure in accordance with the present invention.
Figure 5:
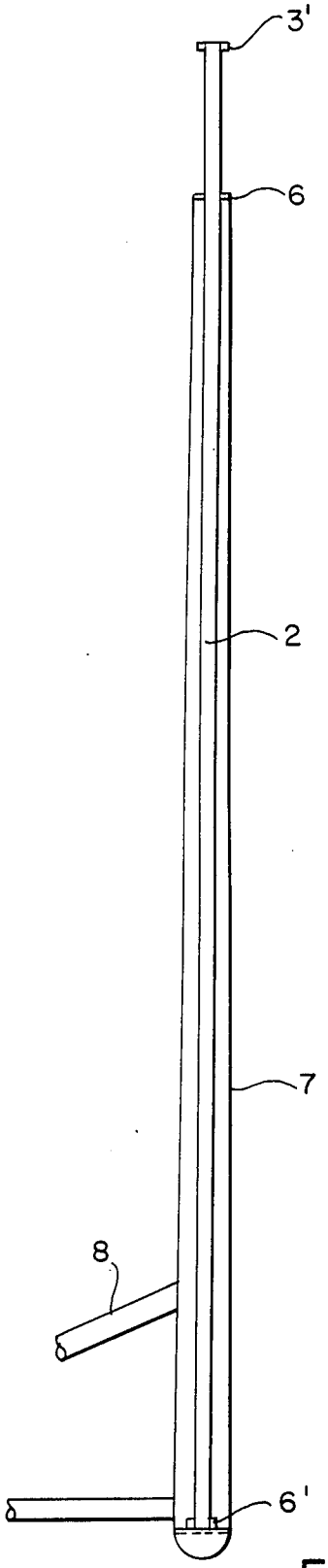
FIG. 5 is a schematic view showing central element 2 inserted into lower terminal connection element 7.

A description is given hereinafter of the procedure for constructing, transporting and installing the structure according to the invention. As the structure is of telescopic design and is divided into two structures to be connected together on the installation site, the installation can be carried out over two different time periods. With reference to FIG. 3, the formation stages are as follows: In stage I, the lower portion of the central tubular element of constant cross-section 2 is inserted into the lower structure formed from the foundation base 8, 9 and lower terminal connection element 7 as shown in FIG. 5. The first sub-structure assembled in this manner is transported horizontally (stage II). In stage III, certain compartments are progressively flooded in order to rotate the structure into a stably floating vertical position.

Further ballasting with water (stage IV) enables it to be installed on the sea bed with the aid of surface means.

At this point, stability of the structure on the sea bed must be ensured, and this in the case of a gravity method is done either by feeding solid ballast into the foundation bases or, if the bases already contain ballast, by flooding the base buoyancy chambers which were kept empty during transportation.

Figure 4:
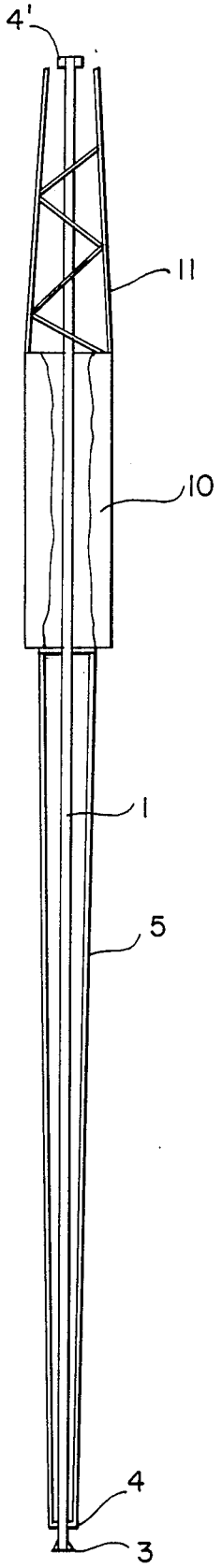
FIG. 4 is a schematic view showing central element 1 inserted into upper terminal connection element 5.

In the case of the method using piled bases, piles must be driven in in order to ensure structural stability under any sea condition. In stage VI, the upper portion of the central element 1 of constant cross-section is inserted into the upper sub-structure formed from the upper terminal connection element 5, positive buoyancy chamber 10 and emerging lattice structure 11 as shown in FIG. 4.

The second sub-structure assembled in this manner is transported horizontally (stage VII).

In stage VIII, certain compartments are progressively flooded in order to rotate the structure into a stably floating vertical position.

In stage IX, the lower portion of the central element 2 contained inside the lower sub-structure is made to rise by pulling it from the surface, until the already prearranged mechanical connection, 6 between said element and the lower terminal connection element is implemented. Simultaneously with this, by flooding suitable compartments and with the aid of winches inside the buoyancy chamber, the upper portion of the central element 1 contained in the upper substructure is lowered until the already prearranged mechanical connection 4 between said element and the upper terminal connection element is implemented.

At this point, by partially flooding the buoyancy chamber, the upper sub-structure is made to emerge until the mechanical connection 3 between the two sub-structures is implemented.

On termination of this operation, ballast water is removed from the buoyancy chamber to give the structure its final operating tension. A continuous structure from the sea bed to the surface is thus formed in which the three mechanical connections which have enabled installation to be carried out are able to re-establish the structural continuity between the connected elements.

In stage X, the vertical conduits for the crude oil flow from the sea bed to the surface plants are launched. The superstructures containing the necessary plants 12 are also installed.

We claim:

1. A deep sea marine structure for use as a hydrocarbon production platform or oil tanker mooring point positioned in proximity to the sea surface comprising:

a foundation base assembly, a tapered bottom terminal element connected to said foundation base assembly, a tapered top terminal element integral with an immersed buoyancy chamber which is located in proximity to the sea surface, said bottom terminal element and said top terminal element being connected by a vertical tubular element, said vertical tubular element is maintained under tension by said immersed buoyancy chamber, a structure supported by said immersed buoyancy chamber located above the surface of the sea, the rigidity of said bottom terminal element decreases in the up direction and the rigidity of said top terminal element decreases in the down direction.

2. A deep sea marine structure according to claim 1, wherein said vertical tubular element is made up of two parts which are connected together by rigid mechanical clamps.

3. A deep sea marine structure according to claim 1, wherein said vertical tubular element is connected to said bottom terminal element and said top terminal element by rigid mechanical clamps.

4. A deep sea marine structure according to claim 1, wherein said structure is constructed at least in part of nonferrous.

5. A deep sea marine structure according to claim 1, including conduits for feeding oil from the sea bed to the surface disposed along the outside of the structure.

6. A deep sea marine structure according to claim 1, including conduits for feeding oil from the sea bed to the surface disposed along the inside of the structure.

7. A method of providing a deep sea marine structure for use as a hydrocarbon production platform or oil tanker mooring point comprising the steps of:

placing a first tubular element in a bottom terminal element, placing a second tubular element in a top terminal element, transporting said elements to a desired location, positioning said bottom terminal element, including said first tubular element on the sea bed, positioning said top terminal element, including said second tubular element, above said bottom terminal element, drawing said first tubular element upwardly from said bottom terminal element and attaching said first tubular element thereto, simultaneously, lowering the second tubular element from said top terminal element and attaching said second tubular element thereto, and connecting said first tubular element and said second tubular element together.

8. A method as claimed in claim 7, wherein said elements are transported in a horizontal orientation.

9. A method as claimed in claim 8, wherein said elements are changed from a horizontal orientation to a vertical orientation prior to positioning.

* * * * *